United States Patent [19]

Sato

[11] 4,313,387

[45] Feb. 2, 1982

[54] METHOD AND APPARATUS FOR CONTROLLING A SOLID FUEL BURNING FURNACE

[75] Inventor: Kanichi Sato, Asahikawa, Japan

[73] Assignee: Hokkai Danro Yugen Kaisha, Asahikawa, Japan

[21] Appl. No.: 124,113

[22] Filed: Feb. 25, 1980

[51] Int. Cl.[3] ..... F23H 5/20

[52] U.S. Cl. ..... 110/192; 110/101 C; 110/101 CF; 110/165 R; 110/328; 110/347

[58] Field of Search ..... 110/186, 185, 191, 192, 110/255, 256, 259, 101 C, 101 CF, 328, 165 R, 347; 431/18

[56] References Cited

U.S. PATENT DOCUMENTS

| | | | |
|---|---|---|---|
| 3,104,629 | 9/1963 | Crawford et al. | 110/191 |
| 3,605,656 | 9/1971 | Stribling | 110/191 |
| 3,855,950 | 12/1974 | Hughes, Sr. et al. | 110/186 |
| 3,861,332 | 1/1975 | Itasaka | 110/259 X |
| 3,880,098 | 4/1975 | McRee | 110/191 |

*Primary Examiner*—Edward G. Favors
*Attorney, Agent, or Firm*—Oblon, Fisher, Spivak, McClelland & Maier

[57] ABSTRACT

A method and apparatus for controlling the burning of a solid fuel furnace is disclosed. In a furnace having a burning chamber, a fuel supply mechanism in the form of a rotating grate, a fuel discharge mechanism in the form of a rotating grate located adjacent the rotating grate of the fuel supply mechanism and at least one air blower, the present invention supplies a control mechanism for controlling the operation of the fuel supply and discharge mechanism as well as the blowers in such a manner that fuel is supplied and discharged in an optimum manner. The control mechanism senses the temperature of the combustion gases and the temperature of the load being heated by the furnace. If the temperature of the load is below a predetermined level and a first time period $T_1$ has not passed since a preceding fuel supply and discharge, the fans are activated but a fuel supply and discharge cycle is not. If the time of the sensing of the low load temperature is below the time $T_1$ and a later predetermined time $T_2$, then the low load temperature signal activates the fuel supply and discharge cycle. If a time of at least $T_2$ has passed since the last fuel supply and discharge cycle, then a subsequent fuel supply and discharge cycle is activated whether the load temperature is low or not.

10 Claims, 9 Drawing Figures

METHOD AND APPARATUS FOR CONTROLLING A SOLID FUEL BURNING FURNACE

BACKGROUND OF THE INVENTION

1. Field of the Invention

This invention relates to a method and apparatus for controlling a solid fuel burning furnace which controls and automatically maintains the burning in the furnace using a solid fuel such as coal, powdered coal and coke. The invention includes the case of a stove to warm up room air with a direct load and a boiler to heat water with a direct load for room heating and supplying heated water.

2. Description of the Prior Art

Conventionally, in this type of burning furnace, a small coal burning boiler for instance, only the water temperature in the boiler is safeguarded with a temperature sensor but the operation of the fire grate is manually performed by measuring a temperature with a thermometer or sensing it with the skin. To maintain the desired heat generating energy, manual vigilance is required. Because of difficulties in accurately knowing the burning condition, the prior art has had such problems as unburnt fuel being discharged when the timing of the operation of the fire grate is too early or the grate being operated too often to meet a rapid change in a room temperature such as at the time of opening and shutting of a door or window, and the burning source is extinguished when the timing is too late.

The present inventors have performed experiments and research and found that time elements $T_1$ and $T_2$ are an important factor to solve these problems, and, based on their knowledge, have accomplished this invention.

SUMMARY OF THE INVENTION

It is an object of this invention to provide a method and apparatus for controlling a solid fuel burning furnace which ensures a stable burning operation by opening a gate between two points in the passage of time from $T_1$ to $T_2$, operating a fuel supply and discharge mechanism and supplying the fuel in compliance with the operation signal received through the gate, and operating the fuel supply and discharge mechanism at $T_2$ from the start in the case of no operation signal being received, thereby avoiding the manual vigilance and labor necessary for the operation of the conventional fire grate and preventing a discharge of unburnt fuel and extinguishing of the burning source.

This invention presents a method for controlling the burning in a solid fuel furnace and comprising a fuel burning chamber to burn the fuel and a fuel supply and discharge mechanism composed of a fuel supply means to supply the fuel to the burning chamber and an ash discharge means to remove ash from the burning chamber, in which the fuel supply and discharge mechanism is operated to control the burning condition in the furnace.

This invention also provides a method for controlling a solid fuel furnace and its apparatus where the fuel supply and discharge mechanism is not operated during the time $T_1$, counted from a certain operation of the fuel and discharge mechanism as its start, by not accepting the operation signal if received, the said fuel supply and discharge mechanism is operated in a predetermined pattern of movements when the operation signal is received after the lapse of the said time $T_1$, and the fuel supply and discharge mechanism is operated even in the absence of the operation signal after the lapse of the time $T_2$.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIG. 7A is the left half portion of the flow sheet and FIG. 7B is the right half portion thereof.

DETAILED DESCRIPTION OF THE PREFERRED EMBODIMENTS

Figure 1:
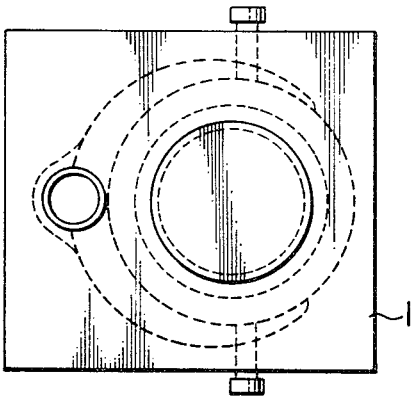
FIGS. 1 and 2 show a boiler in plan and cross section.
Figure 2:
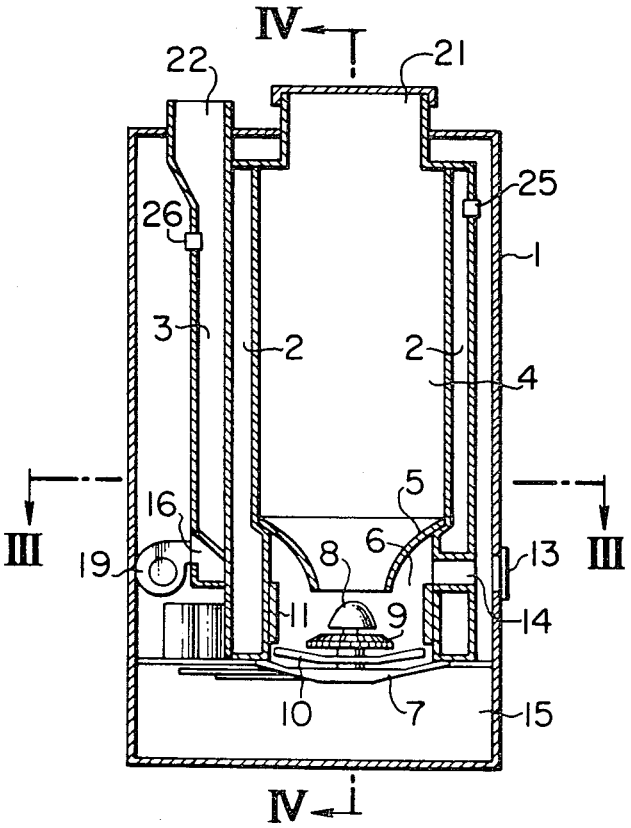
Figure 3:
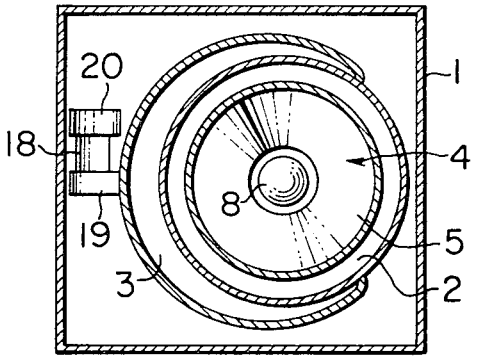
FIGS. 3 and 4 show the cross sections along line III—III and IV—IV in FIG. 2.
Figure 4:
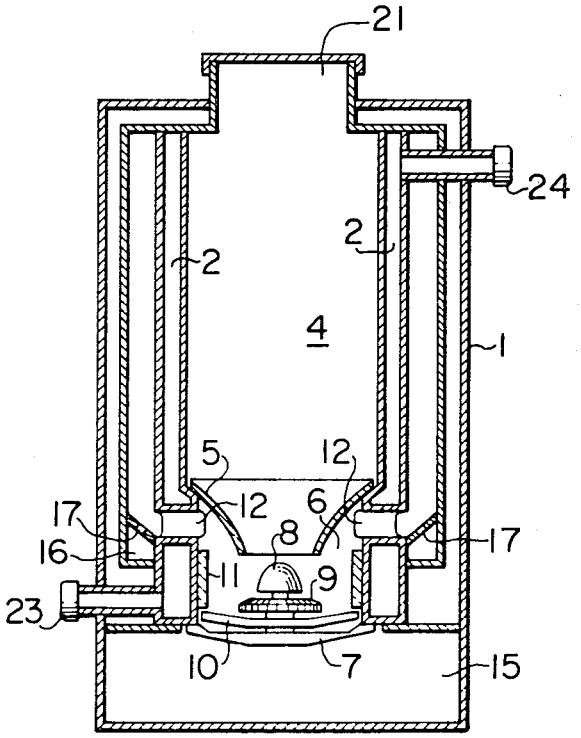

Shown in FIGS. 1 to 6 is an embodiment of the invention with a small coal burning boiler. A case body 1 has within it a cylindrical water tank 2, the outside of which is almost wholly covered with a smoke flue 3. The water tank 2 has an upper inside part forming a coal storage chamber 4, which is designed to store about 60 kg (two or three days supply) of coal powder (including lumps) from primarily smokeless coal. At the lower end of the coal storage chamber 4, there is provided a hopper 5 leading to a burning chamber 6.

The burning chamber 6 has rotatably supported on a beam 7 a fuel supply fire grate 8 functioning as a fuel supplying means, a clinker breaking fire grate 9 and an ash discharge fire grate 10 functioning as an ash discharging means. Their details are explained later.

Designated by FIG. 11 is a heat resisting liner made of such material as heat resisting cast iron.

The burning chamber 6 is connected with the smoke flue through a communicating hole 12. Designated by 13 and 14 are inspection windows to look into the interior of the burning chamber 6.

Below the lower end of the burning chamber 6, an ash chamber 15 is provided, which receives cinders.

Under the lower portion of the smoke flue 3, there is provided a secondary air duct 16, which is linked with the smoke flue 3 through an air conduit hole 17.

Numeral 18 shows a motor to drive a fan 19 for sending a secondary flow of air to the secondary air duct 16 and a fan 20 for blasting a primary flow of air to the burning chamber 6 from its lower portion through the ash chamber 15.

Shown by numeral 21 is a coal supply opening, 22 is a gas discharge opening, 23 is a water supply opening and 24 is a heated water outlet opening.

To measure the temperature of the heated water in the water tank 2, a thermometer 25 is provided in the outer wall of the water tank 2, and thermometer 26 is installed in the outer wall of the smoke flue 3 to measure the temperature of the discharge gas inside the smoke flue 3.

Figure 5:
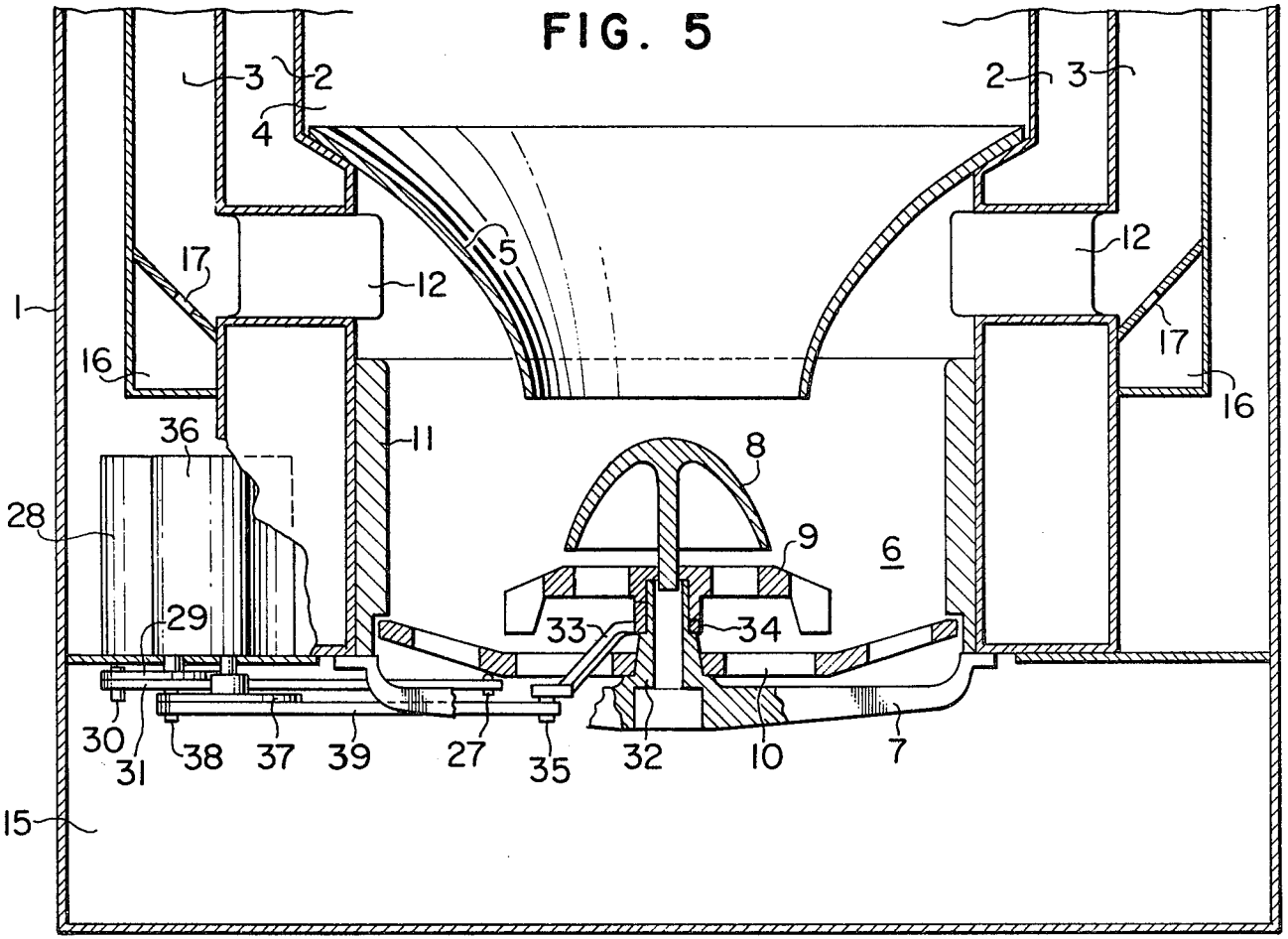
FIG. 5 shows a longitudinal cross section of the structure around the burning chamber.
Figure 6:
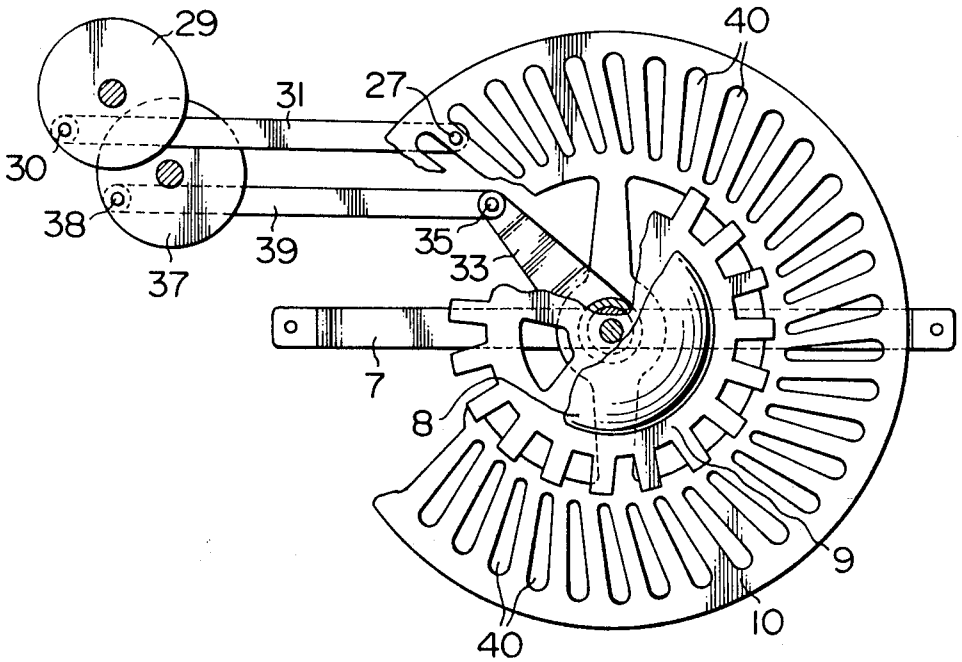
FIG. 6 is a plan view of the fuel supply and discharge mechanism showing a part in cross section.

Next, the structure around the burning chamber 6 is explained in detail along with FIGS. 5 and 6.

The ash discharge fire grate 10 rotatably mounted on a projecting shaft 32 of the beam 7 has a pin 27 projecting from its lower surface, which is connected by a joint rod 31 to a pin 30 provided on a rotary disc 29 of the driving means 28 for oscillating the ash discharge fire grate, so that the ash discharge grate 10 is oscillated in a complete cycle as the rotary disc 29 completes a rotation.

Designated by 33 is an arm rotatably provided around the projecting shaft 32 and its boss 34 serves as a jaw clutch to engage with a boss of the clinker breaking fire grate. At an end of the arm 33, a pin 35 is provided and connected by a joint rod 39 with a pin 35 provided on a rotary disc 37 of a driving means 36 provided outside the burning chamber 6 to drive the clinker breaking fire grate 9 and the fuel supply fire grate 8. The fuel supply fire grate 8 is fixed to and rotates jointly with the clinker breaking fire grate 9. Therefore, when the rotary disc 37 makes a rotation, both the clinker breaking fire grate 9 and the fuel supply fire grate 8 are oscillated in a cycle.

When the ash discharge fire grate 10 is oscillated, ash accumulated thereon drops into the ash chamber 15 through gaps 40. And, when the fuel supply fire grate 8 and the clinker breaking fire grate 9 are oscillated, part of the coal in the coal storage chamber 4 drops through the hopper 5 to be supplied to the furnace and the clinker produced during the burning is broken to clear the gaps 40 at the same time.

Since the relationship between the amount of coal supplied and ash discharged, the oscillating reciprocative movements of the fuel supply fire grate 8, the clinker breaking fire grate 9, the ash discharge fire grate 10, the driving means 28 and 36 and other parts connecting them varies, depending on the kinds of, and characteristics of, coal, it is desirable to determine through prior experiments the optimum movements of each part, an oscillating speed, a time gap and an oscillating angle (in the case of this embodiment of the invention, this cannot be changed, but, if a cylinder is employed, it can be changed by adjusting its stroke) in accordance with the desired amount of supply and discharge and other factors such as kinds and characteristics of coal, and to input their movement patterns into a memory means.

Figure 7A:
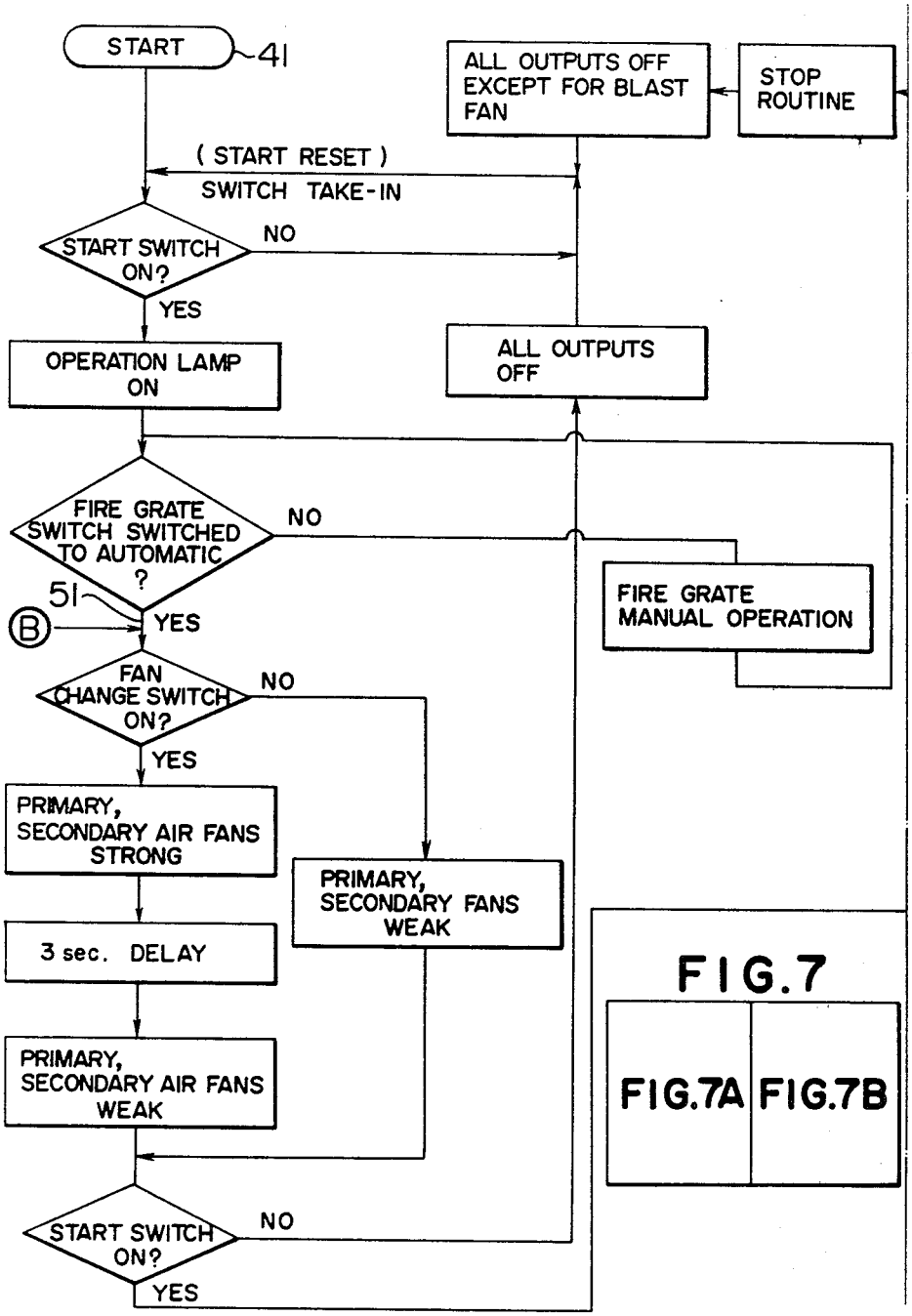
FIG. 7A and FIG. 7B consist of a flow sheet showing an example of an automatic controlling sequence according to the invention.
Figure 7B:
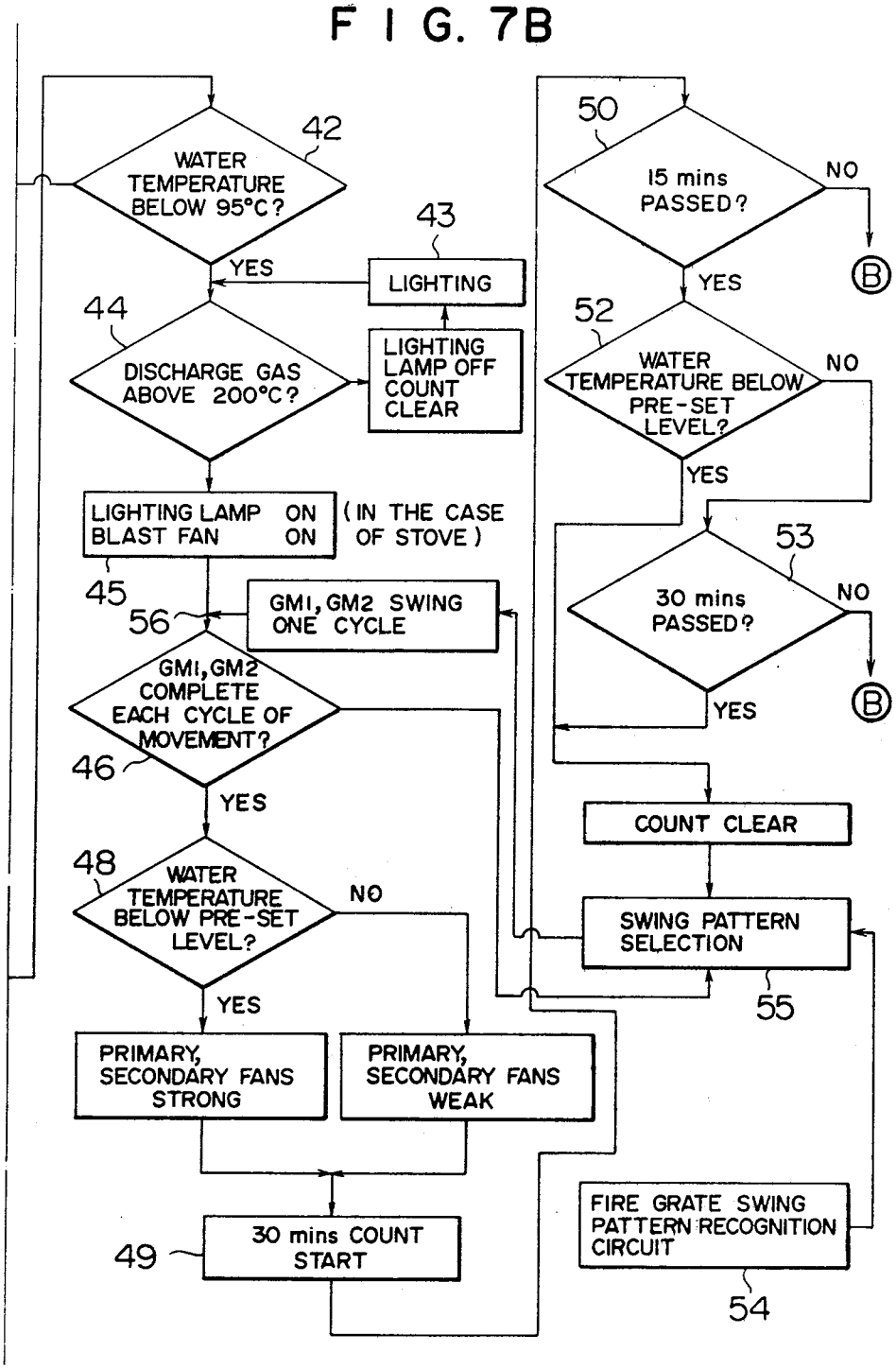

An embodiment of this invention for automatic operation of a small boiler with a structure as mentioned above is shown in FIGS. 7A and 7B. The starting operation 41 as shown in the drawings is implemented by a push button or a touch switch. The judgement 42 is implemented by the thermometer 25 measuring a water temperature in the water tank 2 and serving as a safety sensor and involves a safety circuit, which judges a temperature exceeding 95° C. as dangerous and leads to the stop routine. The lighting operation 43 can be done manually because this requires little labor, and is necessary only once at the start of operation (lighted once at the beginning of winter in the case of a stove), if the automatic operation is ensured perfectly. The judgement 44 involves a circuit to confirm the lighting and is designed to be implemented by the thermometer 26 for the discharge gas temperature. The thermometer 26 need not be highly sensitive and a bimetallic one with a sensing range of from 50° C. to 100° C. can do. The operation 45 is included as a reference in the case of a stove and is not required for a boiler.

In the judgements 46 and 47, $GM_1$ is an oscillation of the ash discharge fire grate 10 and $GM_2$ is that of the fuel supply fire grate 8 and the clinker breaking fire grate 9. A cycle of oscillations is the predetermined number of oscillating reciprocations of $GM_1$ and $GM_2$.

The judgement 48 involves a circuit to conduct its judgement by the thermometer 25 and check whether a temperature reaches a preset level (20° C. to 80° C. . . . continuously adjusted by an operation panel or a digital 20° C., 40° C., 60° C. and 80° C. control, for instance). If the level is satisfied, it maintains the slow operation of the secondary fans 19 and 20, and, if not, strengthens the operation of the fans 19 and 20 to raise a fire force.

The operation 49 involves a counter to measure time, starting almost immediately after $GM_1$ and $GM_2$ are implemented once by the judgement 46 and the operation 47. It is a circuit to start the time counting if it has not started and continue it if it has already started. In this embodiment of the invention, the time $T_1$ is set at 15 minutes and the time $T_2$ at 30 minutes, and the 30 minutes for the operation 49 corresponds to the time $T_2$.

The judgement 50 involves a circuit to determine whether 15 minutes corresponding to the time $T_1$ passes. If the 15 minutes has not passed, it prevents a progress to the next process and provides a return to the return point 51, thereby ensuring a safety check by the judgement 42, the confirmation of the lighting by the judgement 44, the confirmation of the operation of the fuel supply and discharge mechanism by the judgement 46, a check by the judgement 48 of the amount of air for the burning and a check by the judgement 50 of passage of the time $T_1$ and repeating these checks and confirmations until the 15 minutes passes. If any abnormality occurs in this process, counter-measures are automatically taken as described hereinafter. For instance, if the water temperature exceeds 95° C., a dangerous level, the stoppage of operation is instructed by the judgement 42 and re-lighting is done after the counting is cleared by the judgement 44. If the movements of $GM_1$ and $GM_2$ are not implemented despite the start of the counting, a cycle of their oscillations is effected by the judgement 45. When the water temperature falls, the strength of the fans 19 and 20 for the burning is raised to supply the most appropriate amount of air and strengthen the fire force. With these and other countermeasures, the continuation of stable burning is ensured.

In this embodiment of the invention, an operation signal instructing the operation of the fuel supply and discharge mechanism or a supply of fuel is issued from the thermometer 25 of the water tank 2 as a signal requiring a supply of fuel to fill a shortage when the water temperature is lower than a preset level (20° C. to 80° C.). However, before the 15 minutes of time $T_1$ passes, this signal only works to operate the burning fans 19 and 20 at their most appropriate condition but is not accepted as the operation signal for the fuel supply and discharge mechanism. Namely, the gate for the operation signal is closed until the 15 minutes of time $T_1$ passes.

Since the fuel supply and discharge mechanism is not operated, with the operation signal not accepted even if received, when the water temperature temporarily lowers below a preset level, the delay can prevent unlighted and unburnt fuel from being discharged and still inflamable fuel from being wasted by too quick a reaction to a temporary temperature decline.

The passage of the 15 minutes leads to the next process, that is, the judgement 52. The judgement 52 is implemented by the thermometer 25 for the water temperature in the water tank 2. A preset level of water temperature which is the same as that at the judgement 48 is set at from 20° C. to 80° C. Since the already mentioned confirmation operations are repeated before the judgement 52, the burning is kept in the most appropriate state for a boiler. Therefore, the issuing of the signal despite this is judged to indicate a shortage of the fuel after the passage of the time $T_1$, so that it is accepted as an operation signal to supply the fuel by actuating the fuel supply and discharge mechanism.

When the water temperature reaches a preset level and thus no operation signal is issued at the judgement 52, the judgement 53 is implemented. The judgement 53 is to determine whether 30 minutes corresponding to the time $T_2$ from the start of the counting time has passed. If not, it returns to the return point 51 without proceeding to the next process, effecting the said confirmation operations. Thus, when the water temperature does not reach a preset level, (no operation signal is issued) and the time does not pass 30 minutes, a process between the return point 51 and the judgement 53 is repeated, effecting the abovementioned checks, confirmations and counter-measures.

If the water temperature is judged at the judgement 52 to be lower than a preset level during this process, it is accepted as an operation signal, leading to the next process. By the operation 55, the most appropriate operational pattern for the fire grate is selected in accordance with its operational conditions and the kinds and characteristics of the fuel (the operational pattern already selected manually with such a means as a push button is used or an operational pattern is automatically selected by determining such factors as kinds and characteristics of fuel). $GM_1$ and $GM_2$ are oscillated in the predetermined number of reciprocations according to this operational pattern, supplying the preset amount of fuel and returning the process to the return point 56. Namely, after the lapse of the 15 minutes of the time $T_1$, the gate returns to the open position for the operation signal.

Then the process progresses and, when it reaches the operation 49, the time measuring means already cleared is reset, resuming its counting. Accordingly, the passage of time at the judgement 50 is judged as not exceeding 15 minutes and the process is repeated from the return point 51.

When the operation signal (indicating a water temperature below a preset level) is not received while the gate is open after the 30 minutes of time $T_2$ passes, the process is progressed by the judgement 55 to actuate, as in the case where the operation signal is received, the operation 47 for the operation of the fuel supply and discharge mechanism through the operation 55 for the count clearing and operation pattern selection, thereby supplying the preset amount of fuel and preventing the burning source from extinguishing.

As mentioned above, a sequence control can be employed but the use of microcomputer control enables high performance with a compact system.

Figure 8:
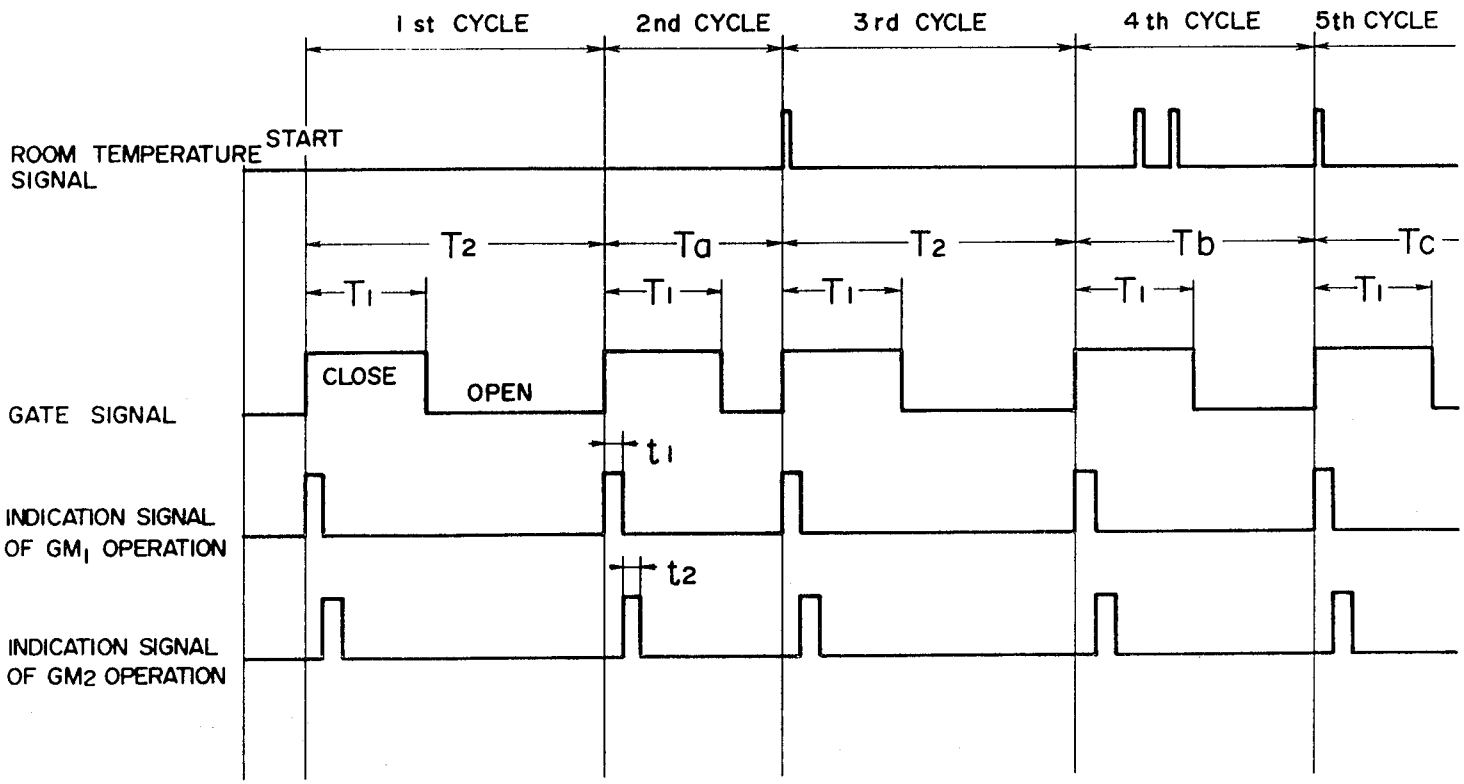
FIG. 8 is a diagram of the operation signals used in the controlling sequence.

FIG. 8 is a diagram showing the operation of each part when automatic controlling is implemented as mentioned above. Shown in the drawing is an embodiment of the invention with a stove. Employed as the operation signal is a room temperature signal (pulse) generated when the temperature of the indoor air or load being measured falls below a preset level.

Time lengths $t_1$ and $t_2$ of the operation signals for $GM_1$ (an oscillation of the ash discharge fire grate 10) and $GM_2$ (an oscillation of the supply fire grate 8 and the clinker breaking fire grate 9) are set to correspond with those of the driving time of the driving means 28 and 36. But, in the case where the driving is implemented by a solenoid, the signal can be given by the number of pulses corresponding to the preset number of reciprocations. Oscillations set by $t_1$ and $t_2$ constitute one cycle of operation of the fuel supply and discharge mechanism.

Each cycle ranges between the start of the $GM_1$ operation signal and the start of the next $GM_1$ operation signal. The gate is closed during the initial time $T_1$ of each cycle and opened after the lapse of the time $T_2$. It remains open until it receives an earlier one of either the temperature signal pulse or the signal for the lapse of the time $T_2$.

Since the room temperature serving as the operation signal is not received in the first cycle after the start, the gate remains closed until the time $T_1$ and then open until being closed upon the lapse of the time $T_2$, upon which the second cycle begins with the next $GM_1$ and $GM_2$ operation implemented. In the second cycle, the room temperature signal is received and accepted in the time $T_a$ set as $T_1$, $T_a$, $T_2$, actuating the next operation of $GM_1$ and $GM_2$. The third cycle, during which the temperature signal is not received, progresses the same as the first cycle. In the fourth cycle, the room temperature signal is received during a period of the time $T_1$ (in the case the room temperature lowers temporarily as at the time of opening and shutting a door or window). In this case, however, the fuel supply and discharge mechanism are not operated because the gate is closed. With the room temperature signal coming in the time $T_b$ set as $T_1$, $T_b$, $T_2$ and accepted, the next operation of $GM_1$, $GM_2$ is implemented and the fifth cycle begins with the gate closing, so that an automatic control to ensure stable and fail-free burning is smoothly maintained.

It is desirable to determine, through prior experiments or according to experience, the most suitable lengths of the time $T_1$ and $T_2$ in accordance with characteristics of the fuel and other conditions for its use and apply them in the most suitable way for conditions at each occasion.

The time $T_1$ can be the time from the completion of a cycle of operation of the fuel supply and discharge mechanism to the consumption of unlighted part of the fuel in the burning chamber. This can prevent a discharge of the unlighted fuel, which can occur when the operation is implemented too early. In this case or another, in order to maintain a fire force without being lowered, the time $T_1$ is desired to be set based on the assumption that it ensures the most appropriate state of burning under certain operational conditions.

Similarly, the time $T_2$ is also desired to be set based on the assumption that it ensures the most appropriate state of the burning under certain operational conditions.

This invention presents a method and apparatus for controlling a solid fuel burning furnace which uses solid fuel and includes a burning chamber for the fuel and a fuel supply and discharge mechanism composed of a fuel supply means to supply the fuel to the burning chamber and an ash discharge means to remove ash from the burning chamber. The fuel supply and discharge mechanism is not operated during the time $T_1$ counted from the start of a certain fuel supply and discharge operation by the mechanism not accepting an operation signal even if received. The fuel supply and discharge mechanism is operated in a certain operational pattern by accepting the operation signal received after the lapse of the time $T_1$, and fuel supply and discharge mechanism is operated even in the absence of the operation signal after the lapse of the time $T_2$, thereby preventing a discharge of unburnt fuel which may be caused by too early an operation of the fuel supply and discharge mechanism. This prevents extinguishing of the burning source which may be caused by too late an operation of the fuel supply and discharge mechanism, and ensures a stable and secure automatic operation, so that manual vigilance and operation labor may be avoided.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for controlling a solid fuel burning furnace according to an operational pattern, said furnace having a burning chamber for said fuel and a fuel supply and discharge mechanism composed of a fuel supply means to supply said fuel to said burning chamber and an ash discharge means to remove ash from said burning chamber, said method controlling the burning condition inside said burning chamber by operating said fuel supply and discharge mechanism and including:

said fuel supply and discharge mechanism rejecting an operation signal if received during a time $T_1$ counted from the start of a predetermined operation of said fuel supply and discharge mechanism, said fuel supply and discharge mechanism accepting the operation signal when received after the lapse of said time $T_1$, and said fuel supply and discharge mechanism operating even in the absence of the operation signal after the lapse of the time $T_2$ from said start, wherein $T_1$ is a time during which the fire force can be maintained after the completion of one operation of said fuel supply and discharge mechanism; and, $T_2$ is a time during which the burning source can remain with the burning continuing after the completion of one operation of the said fuel supply and discharge mechanism.

2. The method of claim 1, wherein said operation signal is a signal showing a load temperature.

3. The method of claim 1, wherein said fuel supply means is a fuel supply fire grate, said ash discharge means is an ash discharge fire grate and wherein a single operation of said fuel supply and discharge mechanism oscillates said ash discharge fire grate in a predetermined number of cycles and said fuel supply fire grate in a predetermined number of cycles.

4. The method of claim 1, wherein the said operational pattern is a certain operational pattern selected from a memory circuit for operational patterns of the fuel supply and discharge mechanism in accordance with the operational conditions of said furnace.

5. The method for controlling a solid fuel burning furnace having a burning chamber for said fuel and a fuel supply and discharge mechanism composed of a fuel supply means to supply said fuel to said burning chamber and an ash discharge means to remove ash from said burning chamber, said method controlling the burning condition inside said burning chamber by operating said fuel supply and discharge mechanism wherein said method comprises:

determining whether a load temperature is within a safety range, confirming the lighting of the fuel, confirming completion of a single operation of the fuel supply and discharge mechanism accepting the operation signal for said fuel supply and discharge mechanism only if received after the lapse of the time $T_1$ counted from the start of a predetermined operation of said fuel supply and discharge mechanism, repeatedly implementing said safety check, opening a gate for the operation signal of said fuel supply and discharge mechanism only after the lapse of said time $T_1$, said safety check and the lighting confirmation being repeatedly implemented until said operation signal is received, operating said fuel supply and discharge mechanism in a certain operational pattern with the operation signal being accepted when received, and operating said fuel supply and discharge mechanism even in the absence of said operation signal after the lapse of the time $T_2$ from said start.

6. In an apparatus for controlling a solid fuel burning furnace having a burning chamber for said fuel and a fuel supply and discharge mechanism composed of a fuel supply means to supply said fuel to said burning chamber, means for controlling the burning inside said burning chamber by operating said fuel supply and discharge mechanism, said means for controlling comprising:

a time measuring means for counting a time from the start of a predetermined operation of said fuel supply and discharge mechanism, a gate circuit for rejecting the operation signal until the time $T_1$ is counted by said time measuring means and for accepting another operation signal between the time $T_1$ and the time $T_2$, an operation circuit for accepting said operation signal and operating said fuel supply and discharge mechanism in a predetermined operational pattern, an operation circuit for operating said fuel supply and discharge mechanism even in the absence of said operation signal after the time $T_2$ is counted from the said start, and a reset circuit to reset the time counting of said time measuring means when said fuel supply and discharge mechanism is operated.

7. The apparatus of claim 6, wherein said operation signal is generated by a thermometer measuring the load of said burning chamber.

8. The apparatus of claim 6, wherein said fuel supply means is a fuel supply fire grate, said ash discharge means is an ash discharge fire grate, and a driving means is provided for separately oscillating said fuel supply fire grate and said ash discharge fire grate.

9. The apparatus of claim 6, wherein said predetermined operational pattern is an operational pattern selected from a memory circuit for operational patterns of said fuel supply and discharge mechanism in accordance with the operational conditions of said furnace.

10. The apparatus of claim 6, wherein a circuit is provided for repeating said safety check to ensure a load temperature to be within a safety range and for the confirmation of the lighting of said fuel between the start and the acceptance of said operation signal.

* * * * *